United States Patent [19]

Bennett

[11] Patent Number: 4,850,266

[45] Date of Patent: Jul. 25, 1989

[54] CENTRAL AIR UPTAKE ATTACHMENT

[76] Inventor: George Bennett, 18485 Kentucky, Detroit, Mich. 48221

[21] Appl. No.: 205,716

[22] Filed: Jun. 13, 1988

[51] Int. Cl.[4] ..... F24F 13/06; F24F 7/06

[52] U.S. Cl. ..... 98/39.1; 98/40.19; 98/102; 98/103; 98/106; 98/108; 98/114

[58] Field of Search ..... 98/31, 31.6, 39.1, 40.14, 98/41.1, 101, 102, 103, 106, 108, 114

[56] References Cited

U.S. PATENT DOCUMENTS

| | | | |
|---|---|---|---|
| 509,332 | 11/1893 | Smith | 98/106 |
| 778,755 | 12/1904 | Mathis | 98/106 |
| 1,021,980 | 4/1912 | Forward | 98/108 |
| 2,088,643 | 8/1937 | Eckenroth | 98/106 |
| 2,389,310 | 11/1945 | Hess | 98/40.1 Y |
| 3,308,746 | 3/1967 | Weiss | 98/114 X |

FOREIGN PATENT DOCUMENTS

| | | | |
|---|---|---|---|
| 10687 | 4/1915 | United Kingdom | 98/106 |

*Primary Examiner*—Harold Joyce
*Attorney, Agent, or Firm*—Dykema Gossett

[57] ABSTRACT

A central air uptake attachment has a housing with upper and lower outlets. The housing is juxtaposable to a room wall air outlet communicating with the ducts of a central air conditioning system. With the room wall, the housing defines an internal chamber for channeling air from the room wall air outlet to the upper or lower outlet. The central air uptake attachment is constructed to be conveniently packaged and transported and readily attached to the room wall.

19 Claims, 2 Drawing Sheets

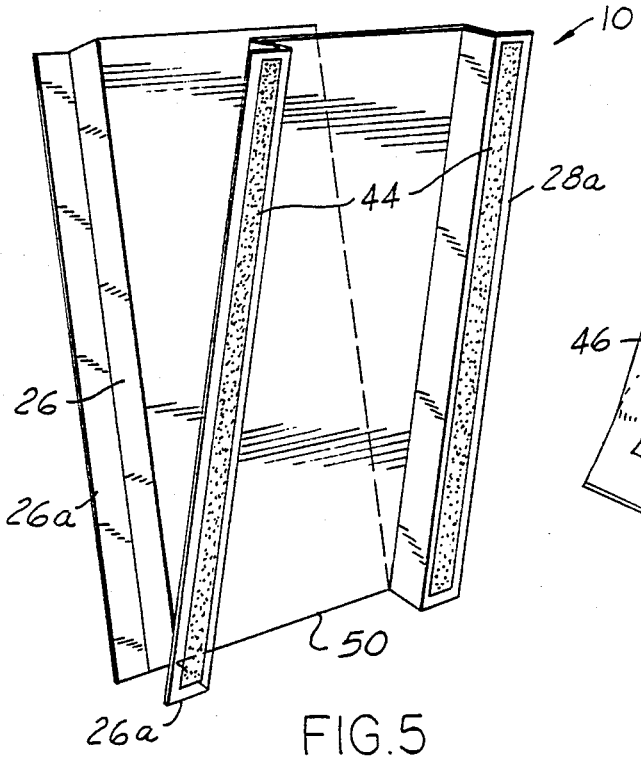
FIG.5
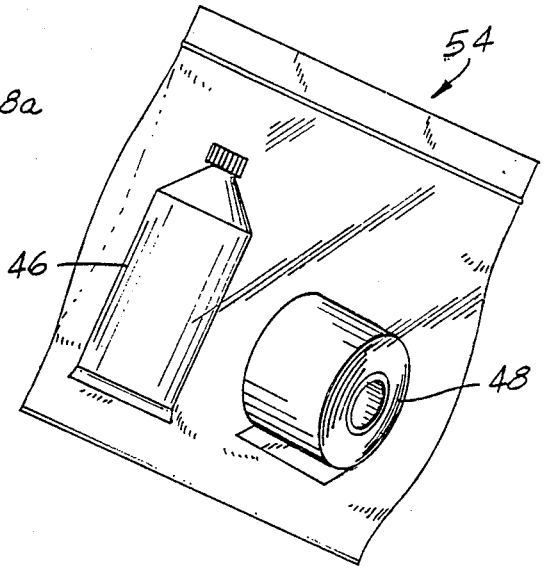
FIG.6
FIG.7
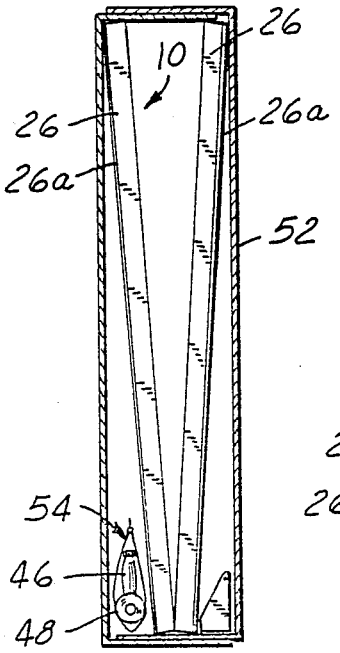
FIG.8
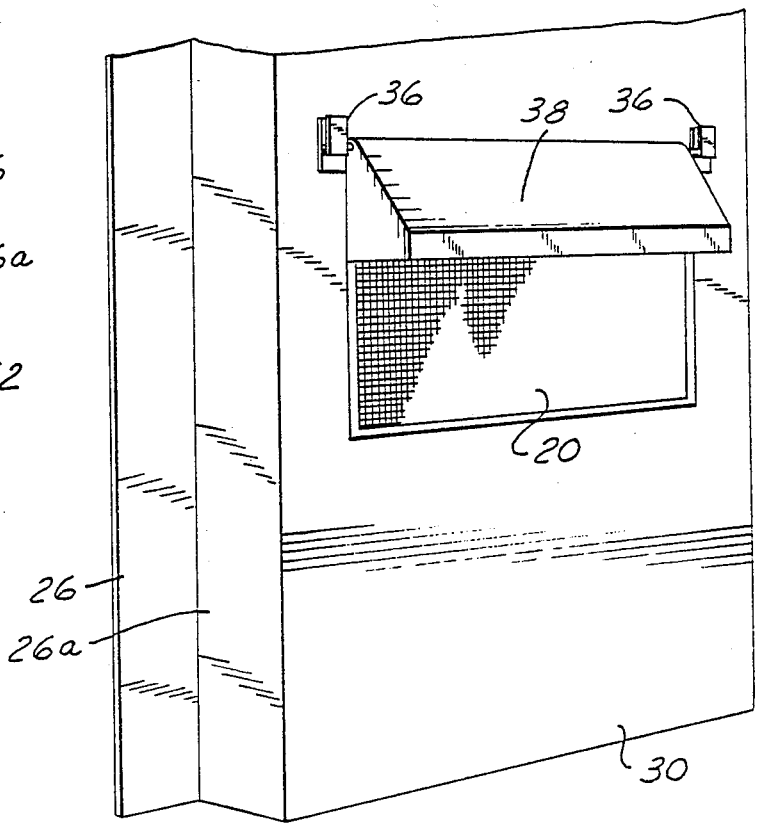

CENTRAL AIR UPTAKE ATTACHMENT

FIELD OF THE INVENTION

The present invention relates generally to air deflectors for directing air from a ventilator into a room. More particularly, the invention relates to air deflectors for central air conditioning systems so that air is directed into a room in a manner that the system efficiently cools the room. Still more particularly, the invention relates a central air uptake attachment for a central air conditioning system, whereby chilled air introduced from a baseboard or floor ventilator is uplifted to an above-head elevation so that the chilled air may be introduced into a warm room to fall and diffuse into the room for efficient cooling thereof.

BACKGROUND OF THE INVENTION

Central air conditioning systems treat air in central air conditioning plants and convey the treated air through ducts to ventilators from which the air is diffused into rooms. Central heating systems do the same, except that the treatment of the air is in a heating plant. It is well known that some central treatment plants both heat and cool and can be regulated to provide air at a desired temperature. Thus, either system or a combined system may be used, depending on the temperature within a room, to bring comfort to human occupants.

Treated air is generally blown into a room under the influence of a blower system, usually housed in the central plant. Once introduced into the room, the treated air rapidly loses momentum generated by the blower system. Thus, the treated air is left to convective currents within the room.

Ventilators may be located at floors, baseboards, and ceilings. As cool air falls and warm air rises, the former locations, those near or at the floor, prove to be efficient for heating, while the latter location proves to be efficient for cooling.

The present invention focuses on the problem arising out of the architectural design of rooms with combination central heating and cooling systems, particularly with rooms designed for central heating systems which subsequently were converted into the combined systems. Many such rooms have ventilators and exhaust grate locations that were designed so that heated air is introduced into a room at lower elevations where it is beneficial to the occupants of the room as it rises to settle near the ceiling where either it is exhausted through an exhaust intake located near the ceiling before it is cooled, or it eventually falls after cooling into the proximity of an exhaust intake at a lower elevation. Such systems operate with a cooling cycle that has cool air being let in at the lower elevations where after a time it builds up while heated air is exhausted from a higher elevation or it is immediately exhausted from the room at the lower elevation without having served to cool the occupants of the room.

OBJECTS OF THE INVENTION

Because of the difficulties associated with air conditioning systems that outlet conditioned air into rooms at low elevations, it is one object of the present invention to provide a central air uptake attachment for directing conditioned air into a room at a high enough elevation for the air to efficiently cool the room for occupants of the room.

It is another object of the present invention to provide a central air uptake attachment for directing treated air into a room at elevations from which the air may be efficiently used to cool or heat the room to suit the occupants of the room.

It is yet another object of the present invention to provide a central air uptake attachment for introducing chilled air into a warm room from an above-head elevation so that the chilled air may fall and diffuse into the room for efficient cooling thereof.

Furthermore, it is an object of the present invention to provide a central air uptake attachment for a wall in a room having a baseboard ventilator or having a floor ventilator adjacent it whereby chilled air introduced from the baseboard or floor ventilator into the room bounded by the wall is uplifted to an above-head elevation so that the chilled air may be introduced into a warm room to fall and diffuse into the room for efficient cooling thereof.

Still further, it is an object of the present invention to provide a central air uptake attachment for a wall in a room having a baseboard or floor ventilator whereby warm air introduced into the room when the room is chilled is introduced at a low elevation so that room air may rise up to warm the room and chilled air introduced from the baseboard or floor ventilator is uplifted to an above-head elevation at which the chilled air may be introduced into the room to fall and diffuse into the room for efficient cooling thereof.

A related object of the invention is to provide a kit for attaching a central air uptake attachment.

Another related object of the invention is to provide a self-contained kit for quickly and conveniently attaching a central air uptake attachment, without requiring tools in addition to the kit.

Yet another related object of the present invention is to provide a kit which may be packaged for sale in a department or hardware store to be conveniently transported in an automobile trunk to the site at which it is to be attached.

SUMMARY OF THE INVENTION

These and other objects are accomplished in the present invention by a central air uptake attachment for a room wall that has a heat and air conditioning outlet. The attachment is to be used in a preferred orientation such that it is structurally distributed between an upper and a lower elevation, and the attachment is to be attached to the room wall over the heat and air conditioning outlet.

A housing for the attachment has a lower air outlet, and an upper air outlet and has an uplift channel between the two outlets. Only one of the two outlets is operative at any one time. One, preferably the lower outlet, is to be used for introducing heating air into the room, and the other, preferably the upper outlet, is to be used for introducing cooled air—air conditioning—into the room.

Preferably, the housing has at least three housing walls. One of the housing walls is a center wall which will be spaced outwardly from the room wall when the attachment is attached to the room wall. The others of the housing walls, then, function as return walls which are generally perpendicular to the center wall, so that the three housing walls, with the complement of the room wall, form a box channel for channeling the conditioned air to the upper outlet when so desired. Accordingly, when the air conditioner wall uptake is used in the preferred orientation and at a preferred location, the center wall is substantially parallel to the room wall, and the return walls are contiguous to, while being substantially perpendicular to, the room wall. Specifically, it is the uplift channel that is a box channel formed of portions of each of the housing walls and the room wall. The four walls thus cooperate to form an open-ended enclosing structure capable of channeling air from the lower to the higher elevation.

The attachment also includes a diverter which also functions as a door. In particular, the diverter operates as a diverter to divert air to the lower air outlet when the lower outlet is being used. At the same time, the diverter closes off the uplift channel so that heated air introduced into the housing from the room wall outlet will not rise to escape through the higher outlet.

Functioning as a door, the diverter closes off the lower outlet so that conditioned air, that is, cooled air, cannot escape through the lower outlet into the room. At the same time, the diverter no longer blocks the uplift channel so that the chilled air can find its way up the uplift channel, constrained by the walls of the housing, to the upper outlet and therethrough escape into the room.

The diverter is pivotally attached to the housing and a lever extends opposite the diverter so that the lever may be used as a means of selecting the orientation of the diverter. Its orientation determines its function as a door or a diverter, particularly with respect to the lower outlet. Because of structural constraints providing for the diverter to function as a door or diverter, the constraints also providing that the housing project minimally into the room from the wall to which it is attached, the lower outlet is preferably located at a higher elevation than the room wall outlet. An optional shield deflector may be used to direct the air downwardly again to the lower elevations within the room if so desired.

The housing is preferably made of lightweight construction material such as plastic, treated paper or cardboard, or mixed materials. Whatever the material, it is to be appreciated by those skilled in the art that the housing may be treated as the wall treatment so that it appears to be the construction of the room. The construction of the housing is also to allow for the attachment to be boxed conveniently for consumers to purchase the attachment in a package which can be taken in the trunk of an automobile and carried to the site of its intended use. Enhancements are provided in the kit package so that the attachment may be attached to a wall without other tools being needed.

BRIEF DESCRIPTION OF THE DRAWINGS

FIG. 5 is a perspective view of the central air attachment of either of the embodiments shown in FIGS. 1 and 2, showing means for attaching the attachment and also showing how the attachment is folded for packaging.

FIG. 6 is a view of the enhancements packaged with the central air attachment for use in attaching the attachment.

FIG. 7 is a sectional view showing the folded attachment of FIG. 5 in a packaging box.

FIG. 8 is an enlarged partial view of the central air uptake attachment shown in FIG. 1.

DETAILED DESCRIPTION OF THE PREFERRED EMBODIMENT

Figure 1:
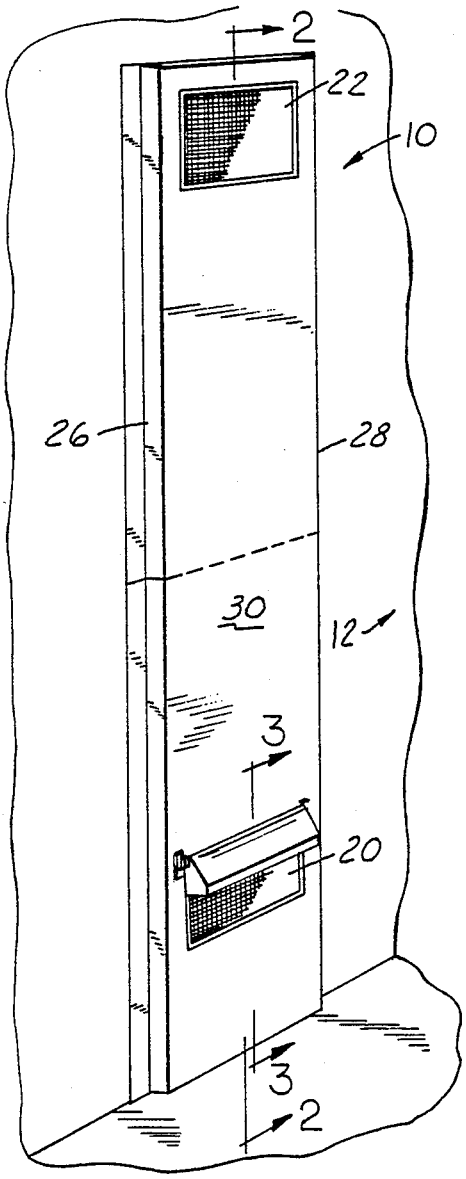
FIG. 1 is a perspective view of a first embodiment of the central air attachment according to the present invention.

Referring first to FIG. 1, a central air uptake attachment for a room wall is shown generally at 10. As the shape and dimensions of the central air uptake attachment 10 are generally characteristic of the shape and dimensions of its housing, the housing is also represented in general by numeral 10. The attachment and housing 10 is to be used in a preferred orientation such that it is structurally distributed between an upper and a lower elevation.

Figure 2:
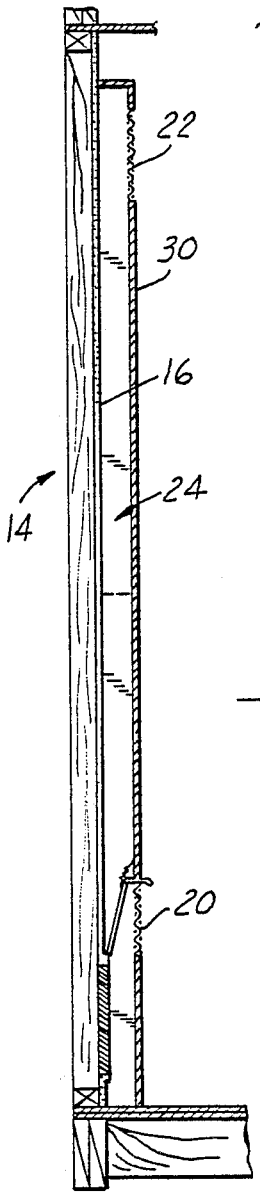
FIG. 2 is a sectional view taken in the direction of arrows 2—2 of FIG. 1.
Figure 3:
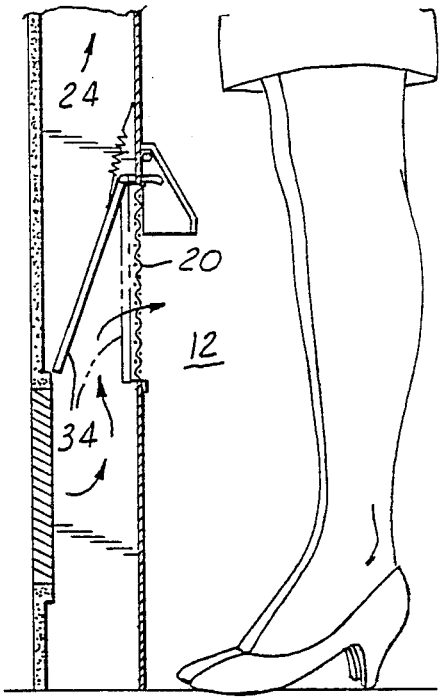
FIG. 3 is an enlarged partial sectional view taken in the direction of arrows 3—3 of FIG. 1.
Figure 4:
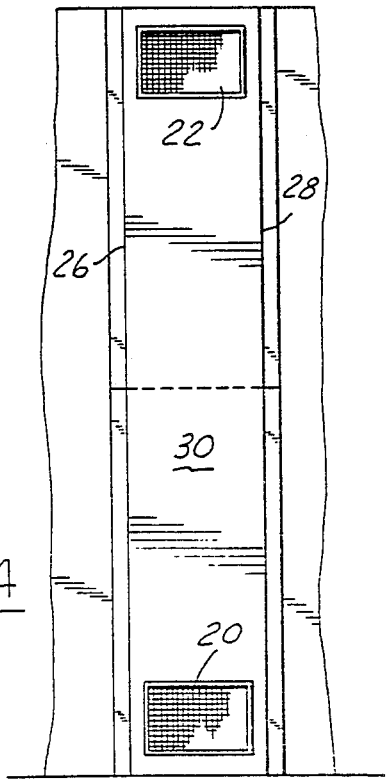
FIG. 4 is a front elevational view of a second embodiment of the central air attachment according to the invention.

A room 12 is bounded by a conventional wall construction, shown generally at 14 in FIGS. 2 and 3. The wall construction 14 includes a wall 16, typically constructed of plasterboard or plastic and lathe, through which a conditioned air wall outlet 18 or registry is situated. Room air outlet 18 lets air conditioned by being heated in a furnace or cooled by a compressor into the room 12 respectively for cooling room 12 or for heating room 12.

In a manner later to be explained, housing 10 is to be attached to room wall 16 (see FIG. 2), while positioned over existing heat and air conditioning wall outlet 18 of wall 16. Housing 10 has a lower air outlet 20 and an upper air outlet 22, only one of which is operative at any one time. One of the outlets 20 and 22, preferably the lower outlet 20, is to be used for introducing heated air into room 12. The other of the outlets 20 and 22, preferably the upper outlet 22, is to be used for introducing cooled air—that is, air conditioning—into room 12.

Between lower air outlet 20 and upper air outlet 22, housing 10 comprises an uplift channel 24. Preferably, housing 10 has at least three housing walls 26, 28 and 30. Two walls 26 and 28, which are parallel to one another, function as return walls for a center wall 30. As shown in FIG. 2, center wall 30 is to be spaced outwardly from room wall 16 when attached thereto. Return walls 26 and 28 are generally perpendicular to center wall 30. Return walls 26 and 28 have respective flanges **26*a* and 28*b* connected along the lengths of returns walls 26 and 28. Flanges 26*a* and 28*b* mount flushly against wall 16** in a manner later to be explained.

The three housing walls 26, 28 and 30, with the complement of room wall 16, form a box channel that is an air conditioner wall uptake 32 for channeling the conditioned air to the upper outlet 22 when so desired. Accordingly, when the air conditioner wall uptake attachment incorporated in housing 10 is used in the preferred orientation and at a preferred location, center wall 30 is substantially parallel to room wall 16, and the return walls 26 and 28 are contiguous to, while being substantially perpendicular to, the room wall 16. More specifically, the uplift channel 32, which is a box channel, is formed of portions of each of the housing walls 26, 28 and 30 situated between lower and upper outlets 20 and 22 and room wall 16. The four walls 16, 20, 22 and 30 thus cooperate to form an open-ended enclosing structure capable of channeling air from the lower to the higher elevation.

Referring more particularly to FIG. 3, the attachment incorporated in housing 10 also includes a diverter 34. Diverter 34 also functions as a door. First, diverter 34 functions or operates to divert air to the lower air outlet 20 when the lower outlet 20 is being used. Second, at the same time, the diverter 34 closes off the uplift channel 24 so that heated air introduced into the housing from the room wall outlet will not rise to escape through the higher outlet 22.

Functioning as a door as shown in phantom in FIG. 3, diverter 34 closes off the lower outlet 20 so that conditioned air, that is, cooled air, cannot escape through the lower outlet 20 into room 12. At the same time, diverter 34 no longer blocks the uplift channel 24 so that the chilled air can find its way up the uplift channel 24, constrained by walls 26, 28 and 30 of housing 10, to upper outlet 22 and therethrough escape into room 12.

Still referring to FIG. 3 but also with reference to FIG. 8, diverter 34 is pivotally attached to housing 10 by means known to those skilled in the art, as for example, by clips such as clips 36 shown on the outside of housing 10 supporting a deflector 38 whose function will be explained. A lever 40 extends generally opposite diverter 34 so that lever 40 may be used as a means of selecting the orientation of diverter 34. The orientation of diverter 34 determines the function of diverter 34 as a door or a diverter, particularly with respect to lower outlet 20.

Architectural constraints limit the projection of housing 10 into room 12. For example, a projection from wall 16 of about four inches, that is, the distance between parallel walls 16 and 30, would not be an overbearing obtrusion upon room 12 from both aesthetic and space-saving perspectives. But such constraints while providing for diverter 34 to function as a door or diverter, call for a preferable location lower outlet 20 at a higher elevation than room wall outlet 20, as is shown in FIGS. 2 and 3. This structural aberration allows diverter 34 to be pivoted open across the housing so as to touch wall 16 without having the leading edge of wall 16 intercepted by wall outlet 18.

An optional shield deflector 38, shown with particularity in FIG. 8, may be used to direct the air downwardly again to the lower elevations within the room if so desired. Deflector 38 is provided with rod projections to fit into clips 36 located to either side of outlet 20 so that deflector 38 may be removed to expose lever 40.

Figure 9:
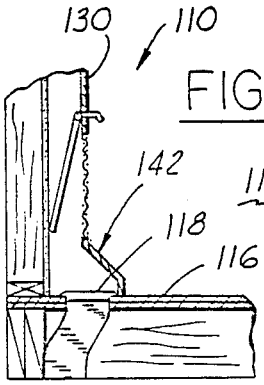
FIG. 9 is a partial section of another embodiment of the central air uptake attachment.

FIG. 9 shows another embodiment of the invention which is suitable for a floor vent 118 in a floor 116*a*. Except for a projection 142 of wall 130 outwardly into room 112, and side walls of housing 110 that meet all edges of wall 130, the central air uptake attachment is in all respects the same as in the embodiments shown in the other figures.

Housings 10 and 110 are preferably made of lightweight construction material such as plastic, treated paper or cardboard, or mixed materials. Whatever the material, it is to be appreciated by those skilled in the art that housing 10 or 100 may be treated as the wall treatment to which housing 10 or 110 is attached, so that the central air uptake attachment appears to be a part of the construction of room 12 or 112. As can be seen in FIG. 5, housing 10 may be provided, on the backs of flanges 26*a* and 28*a*, with pressure-sensitive adhesive strips 44 for attachment to wall 16 of FIG. 1. Other means of attachment, such as by use of epoxy or other types of bonding material 46 and masking or covering tapes 48 shown in FIG. 6, may also be used. Bonding material 46 would be used on flanges 26*a* and 28*a* in lieu of or in conjunction with adhesive strips 44. Tape 48 may be used over the flanges 26*a* and 28*a* in a "tape and float" operation to visually blend the central air uptake attachment into the wall treatment in a manner well-known in the home improvement arts.

The construction of housing 10 allows for the central air uptake attachment to be boxed conveniently for consumers to purchase the central air uptake attachment. As seen in FIGS. 1, 5, and 7, a fold line 50 in housing 10 allows housing 10 to fit into a convenient-sized kit package 52 which can be placed in the trunk of an automobile and carried to the site of its intended use. Enhancements 46 and 48 are provided in a tool packet 54 included in the kit package 52, so that the central air uptake attachment may be attached to a wall without other tools being needed.

I claim:

1. A central air uptake attachment for use in a preferred orientation such that the central air uptake attachment is structurally distributed between an upper and a lower elevation, the central air uptake attachment comprising:

a housing that includes a lower air outlet, an up channel, and an upper air outlet, no more than one of said outlets being operative at any time, the housing having at least three housing walls, one housing wall being a center wall and two housing walls being return walls, each return wall having a first side extending along the center wall and attached thereto and each return wall being generally perpendicular to the center wall so that, when the central air uptake attachment is used in the preferred orientation and at a preferred location within a room having a room wall, the center wall is substantially parallel to the room wall, and each return wall having a second side contiguous to the room wall and the up channel being formed of portions of each of the housing walls and the room wall, the portions cooperating to form an open-ended enclosing structure capable of channeling air from the lower to the upper elevation;

a diverter that operates as a door to close off the lower air outlet when selection means is operated in a first manner, thereby making the lower air outlet inoperative, and as a diverter to divert air to the lower air outlet by closing off the up channel, when selection means is operated in a second manner, thereby making the upper air outlet inoperative; and selection means for selecting between making the lower air outlet operative and making the upper air outlet operative, whereby, when the air conditioner uptake is placed in the preferred location whereat it is adjacent the room wall air outlet in the room wall of the room, selection may be made using said selection means to bring cool air into the room through the upper air outlet and warm air into the room through the lower air outlet.

2. The central air uptake attachment of claim 1 wherein the upper elevation is at least three feet above the lower elevation.

3. The central air uptake attachment of claim 2 wherein the upper and lower air outlets are through the center wall.

4. The central air uptake attachment of claim 3 wherein, when the central air uptake attachment is used in the preferred orientation and at the preferred location, the lower air outlet has an upper and lower boundary and the diverter is a pivotal door having a lower edge and a pivot axis located remotely from the room wall so that the diverter is pivotal upwards from said lower boundary towards the room wall until the lower edge makes contact with the room wall.

5. The central air uptake attachment of claim 4 wherein, when the central air uptake attachment is used in the preferred orientation and at the preferred location, the lower air outlet is generally located at a higher elevation than the room wall air outlet.

6. The central air uptake attachment of claim 5 wherein a deflector is removably located at the upper boundary of the lower air outlet to deflect air passing therethrough into the room toward the floor of the room.

7. The central air uptake attachment of claim 1 wherein each of the return walls has a flange attached to the second side of the return wall, the flange being substantially parallel and contiguous to the room wall when the central air uptake attachment is in the preferred orientation and at the preferred location.

8. The central air uptake attachment of claim 7 wherein the flange of each return wall has an adhesive backing attached thereto so that, when the central air uptake attachment is in the preferred orientation and at the preferred location, the flange is pressable into adhesive contact with the room wall.

9. The central air uptake attachment of claim 7 wherein the flange of each return wall is attachable to the room wall by a bonding material spread between the flange and the room wall.

10. The central air uptake attachment of claim 7 wherein the flange of each return wall is attachable to the room wall by adhesive tape.

11. A kit for building a central air uptake attachment for use in a preferred orientation such that the central air uptake attachment will be structurally distributed between an upper and a lower elevation, the kit comprising:

a housing that includes a lower air outlet, an up channel, and an upper air outlet, no more than one of said outlets to be operative at any one time, said housing also including means for folding said housing to fit said housing in packaging means, said housing, when unfolded, having at least three integral housing walls, each wall being bounded by two generally parallel sides, one housing wall being a center wall and two housing walls being return walls, each return wall having one side contiguous to a respective side of the center wall so that each return wall may be oriented generally perpendicular to the center wall and so that, when the central air uptake attachment is used in the preferred orientation and at a preferred location within a room having a room wall, the center wall will be substantially parallel to the room wall, the return walls will be contiguous to and substantially perpendicular to the room wall, and the up channel will be formed of portions of each of the housing walls and the room wall, whereby the portions of the housing walls and the room wall will cooperate to form an open-ended enclosing structure capable of channeling air from the lower to the higher elevation, the center wall having an interior surface facing inwards of the enclosing structure;

a diverter pivotally attached to an interior surface of the center wall and having selection means extending through the center wall, the diverter to be operable as a door, when the housing is unfolded and in the preferred orientation to close off the lower air outlet when the selection means is operated in a first manner, and the diverter to be operable to divert air to the lower air outlet and to close off the up channel when selection means is operated in a second manner; and packaging means for packaging the folded housing and the diverter.

12. The kit of claim 11 wherein the upper and lower air outlets are through the center wall.

13. The kit of claim 11 wherein, when the central air uptake attachment is used in the preferred orientation and at the preferred location, the lower air outlet has an upper and lower boundary, and the diverter is a pivotal door having a lower edge and a pivot axis located remotely from the room wall so that the diverter is pivotal upwards from said lower boundary towards the room wall until the lower edge makes contact with the room wall.

14. The kit of claim 13 wherein, when the central air uptake attachment is used in the preferred orientation and at the preferred location, the lower air outlet is generally located at a higher elevation than the room wall outlet.

15. The central air uptake attachment of claim 14, further comprising a deflector attachable at the upper boundary of the lower air outlet to deflect air passing through the lower air outlet into the room toward the floor of the room.

16. The kit of claim 11 wherein each return wall has an integral folded, unfoldable flange which may be placed contiguous to the room wall and substantially parallel therewith.

17. The kit of claim 16 wherein the flange of each return wall has an adhesive backing so that, when unfolded, the flange may be pressed into adhesive contact with the room wall.

18. The kit of claim 16 further comprising a tool packet including enhancements for attaching each flange to the room wall without other tools being needed.

19. The kit of claim 11 wherein the means for packaging is a cardboard box.

* * * * *